US008640309B2

(12) United States Patent
Ott et al.

(10) Patent No.: US 8,640,309 B2
(45) Date of Patent: Feb. 4, 2014

(54) DEVICE FOR ATTACHING A FLEXIBLE CLOTHING IN A TEXTILE MACHINE

(75) Inventors: Jürg Ott, Schaffhausen (CH); Hans-Peter Schatzmann, Uesslingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 72 days.

(21) Appl. No.: 13/363,653

(22) Filed: Feb. 1, 2012

(65) Prior Publication Data

US 2012/0305609 A1 Dec. 6, 2012

(30) Foreign Application Priority Data

Feb. 1, 2011 (CH) ..... 0180/11

(51) Int. Cl.
*D01G 15/24* (2006.01)

(52) U.S. Cl.
USPC ..... 19/102

(58) Field of Classification Search
USPC ..... 19/102, 104, 113, 114; 140/97, 100
See application file for complete search history.

(56) References Cited

U.S. PATENT DOCUMENTS

| | | | | |
|---|---|---|---|---|
| 564,691 | A * | 7/1896 | Hunton | 19/113 |
| 575,986 | A * | 1/1897 | Potter | 19/113 |
| 581,749 | A * | 5/1897 | Mills | 140/97 |
| 7,559,122 | B2 * | 7/2009 | Schatzmann et al. | 19/113 |
| 8,186,020 | B2 * | 5/2012 | Schatzmann | 19/104 |
| 2004/0000133 | A1 * | 1/2004 | Wassenhoven et al. | 57/406 |
| 2008/0288101 | A1 * | 11/2008 | Meixner et al. | 700/139 |
| 2008/0307611 | A1 * | 12/2008 | Schatzmann et al. | 19/113 |
| 2010/0306965 | A1 * | 12/2010 | Schatzmann | 19/113 |

FOREIGN PATENT DOCUMENTS

SU 1745782 A2 7/1992

* cited by examiner

*Primary Examiner* — Shaun R Hurley
(74) *Attorney, Agent, or Firm* — Dority & Manning, P.A.

(57) ABSTRACT

A device attaches a flexible clothing in the form of a clothing strip to a card flat bar of a revolving card flat. The card flat bar has a card flat foot with a clothing take-up surface and a web lying above the card flat foot. At least two clips are provided on the clothing strip. The device includes means to accommodate and hold the card flat bar and the clothing strip. The device furthermore includes press rams, which are guided in a moveable manner transversely to the longitudinal direction of the card flat bar and from both sides parallel to the clothing take-up surface of the card flat bar. By means of the movement of the press rams, an integral formation of the clips on the card flat foot is caused. The press rams have a drive with compression hoses.

8 Claims, 2 Drawing Sheets

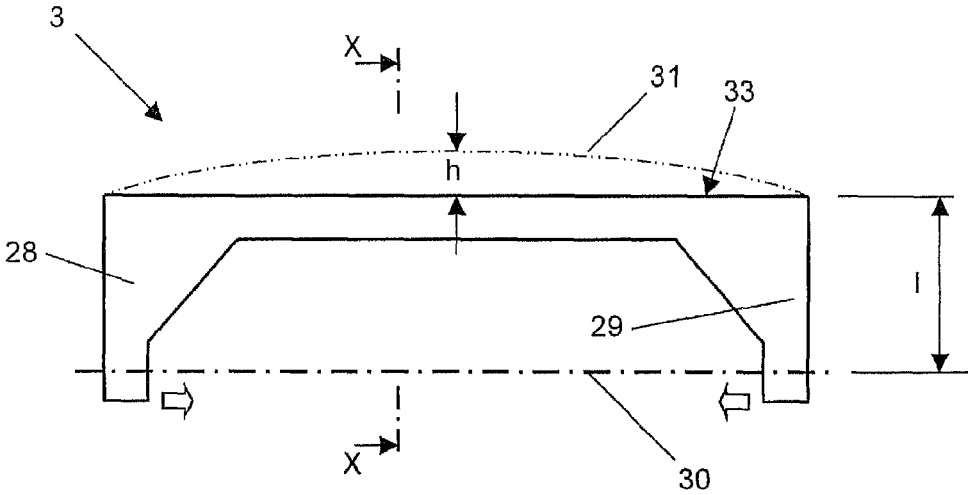
Fig. 3
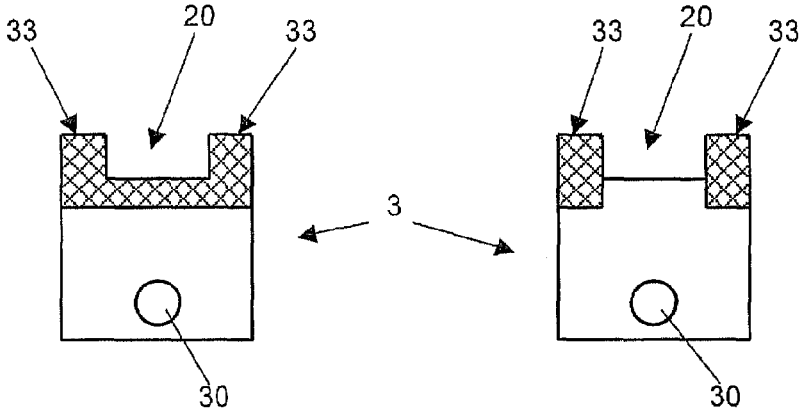
Fig. 4a
Fig. 4b

DEVICE FOR ATTACHING A FLEXIBLE CLOTHING IN A TEXTILE MACHINE

FIELD OF THE INVENTION

The invention relates to a device for attaching a flexible clothing in the form of a clothing strip to a card flat bar of a revolving card flat. The card flat bar has a card flat foot with a clothing take-up surface and a web lying above the card flat foot. The clothing strip is attached to the card flat foot with at least two clips.

BACKGROUND

Various embodiments of devices for attaching clothing strips to revolving card flats are known from the prior art. SU 1 745 782 discloses a device into which the clothing strip and the card flat bar are placed. The card flat bar thereby bears on the clothing strip and the clothing strip is supported on two plates. The two plates are arranged such that the clothing strip bears only with the outer edges, which do not have any equipment with a clothing. The card flat bar and the clothing strip are held in the device and the clips are integrally formed with press rams on the card flat foot from both sides. The press rams are thereby pressed down on the card flat foot with spring force. The press rams are moveably supported and shaped in their end facing towards the card flat foot such that the pressed-in clips can wrap around the card flat foot at more than one right angle.

The disadvantages of the device of SU 1 745 782 lie in the complex construction of the press rams. Likewise, there is the danger of an uneven operation of the press rams due to the necessary mobility perpendicular to the direction of movement against the card flat foot in order to achieve a bending of the clips of more than 90°.

In WO 2009/067821, a device for attaching clothing strips to revolving card flats is disclosed, which uses elastic press rams. This is rendered possible in that the clips have to be bent by less than 90°. In order to achieve a uniform movement of the press rams, the use of a linear drive is proposed. However, since revolving card flats up to a length of 1.50 meters are to be provided with clothing strips and accordingly the press rams also have such a length, the use of linear drives is structurally complex and cost intensive.

SUMMARY

An object of the invention is to eliminate the disadvantages of the prior art and to create a device that renders possible a uniform movement of the press rams over the entire length.

A further object of the invention is to create a device which makes it possible to attach flexible clothings to card flat bars of different overall lengths.

Additional objects and advantages of the invention will be set forth in part in the following description, or may be obvious from the description, or may be learned through practice of the invention.

The objects are attained by the features in the distinguishing portion of the appended claims.

In accordance with the invention, a device is proposed for attaching a flexible clothing in the form of a clothing strip to a card flat bar of a revolving card flat. The card flat bar has a card flat foot with a clothing take-up surface and a web lying above the card flat foot. At least two clips are provided on the clothing strip. The device comprises means in order to accommodate and to hold the card flat bar and the clothing strip. The device furthermore comprises press rams, which are guided in a moveable manner transversely to the longitudinal direction of the card flat bar and from both sides parallel to the clothing take-up surface of the card flat bar. The movement of the press rams causes an integral forming of the clips on the card flat foot. The press rams have a drive with compression hoses.

The card flat bar and the clothing strip are placed into the device. The clips for attaching the clothing strips to the card flat foot are thereby already attached to the clothing strip along the longitudinal sides thereof. For the mounting of the clothing strip, a receiving member is provided in the device, which receiving member has a depression in the center over its entire length. The clothing strip bears on the clips on the receiving member, wherein the clothing is accommodated in the depression. The card flat bar is located above the clothing strip and bears with the clothing take-up surface on the clothing strip. The card flat bar is pressed over the web on the clothing strip and thus against the receiving member and held. The pressing force necessary for this is advantageously generated via a compression hose.

Compression hoses of identical design are used as a drive for the press rams. The movement of the press rams is carried out in a guided manner. The guidance of the movement can be carried out by a corresponding arrangement of ribs on the card flat foot. It is also conceivable that a guidance of the press rams is carried out by suitable components in the device itself, for example, by rails or rods that prevent a movement of the press ram out of a plane lying parallel to the clothing take-up surface.

A compression hose is a flexible structure, for example a woven fabric or a reinforced plastic film, which is arranged in a housing. The compression hose is filled with a pressure medium and a specific overpressure is applied thereto. Compressed air or a hydraulic fluid is suitable as pressure medium. Due to the pressure application, the compression hose expands until it reaches the size of its housing. If piston rods are inserted through the housing wall, they are pushed outwards by the compression hose. In an advantageous embodiment, the press rams are used as piston rods, whereby the compression hose acts on the entire length of the press rams.

In a further embodiment, a piston is provided between the compression hose and the press ram. A larger working surface for the compression hose can be provided by means of the piston. The passage through the housing for the connection between the piston and press ram can thereby be formed as a narrow slot or individual through-holes. Regardless of the embodiment of this connection, the press rams or the piston can extend over the entire length of the card flat bar. Due to the fact that only the compression hose is under an increased internal pressure, the passages through the housing can be embodied without complex seals.

Advantageously, the compression hose is operated with compressed air. If the compression hose is made of an elastic material and attached to the wall of the housing facing away from the press ram on the one side and on the press ram on the opposite side, a backward movement of the press ram occurs with the relief of the compression hose. Due to the elasticity of the compression hose, it is stretched during the pressure application and contracts to its original size upon relief of pressure. However, the reset can also be achieved by spring force or other suitable drive means.

In a further embodiment, the device can be divided into sections along its length. The means for holding the card flat bar, as well as the press rams and compression hoses, are thereby subdivided into sections. It is thereby possible to process card flat bars with different lengths.

The means for accommodating the card flat bar and the clothing strip comprise a bearing surface that extends over the entire length of the card flat bar. Card flat bars are produced with a certain linearity. Short card flat bars are generally embodied to be as straight as possible, so that a clothing take-up surface in one plane results. Longer card flat bars, for example, more than one meter, are produced with a concave clothing take-up surface. The clothing take-up surface follows a curve seen over the length of the flat. In order that, while the card flat bar is held in the device, a card flat bar produced in a concave manner is not pressed flat, and thus the clothing strip is attached to a card flat bar that is under tension, the linearity of the bearing surface is adjustable in the longitudinal direction of the card flat bar.

In a preferred embodiment, the means for accommodating the card flat bar is fixed in the device at its two ends. The two ends are connected to a clamping device at a specific distance from the bearing surface. The linearity of the bearing surface is changed by drawing the two ends together with the aid of the clamping device. The bearing surface becomes convex, so that a card flat bar produced in a correspondingly concave manner bears over its entire length on the clothing strip and thus on the bearing surface. During the subsequent holding of the card flat bar, the bar is not deformed. Clamping devices are also conceivable which do not connect the two ends to one another, but lift the means for bearing the card flat bar in the middle thereof. Suitable clamping devices are known from the prior art, for example tie rods or springs.

The adjusted linearity of the bearing surface can be displayed by means of the position of the clamping devices. Based on the different card flat bar constructions known from the prior art, an adjustment of the linearity from 0 to 0.2 mm is advantageous.

The device is provided with a cover on all sides. Cutouts are provided on the front face. The card flat bar and the clothing strip can be pushed into the device through these cutouts. The advantage of this design is that the means for holding the card flat bar do not have to be pivoted aside during the loading or unloading operation.

BRIEF DESCRIPTION OF THE DRAWINGS

The invention is explained below based on an exemplary embodiment and illustrated in more detail by drawings.

FIG. 3 is a diagrammatic representation of an embodiment of a receiving means for bearing of the card flat bar and the clothing strip; and FIGS. 4*a*, 4*b* are diagrammatic sectional representations of two embodiments of the receiving means at the position X-X in FIG. 3.

DESCRIPTION

Figure 1:
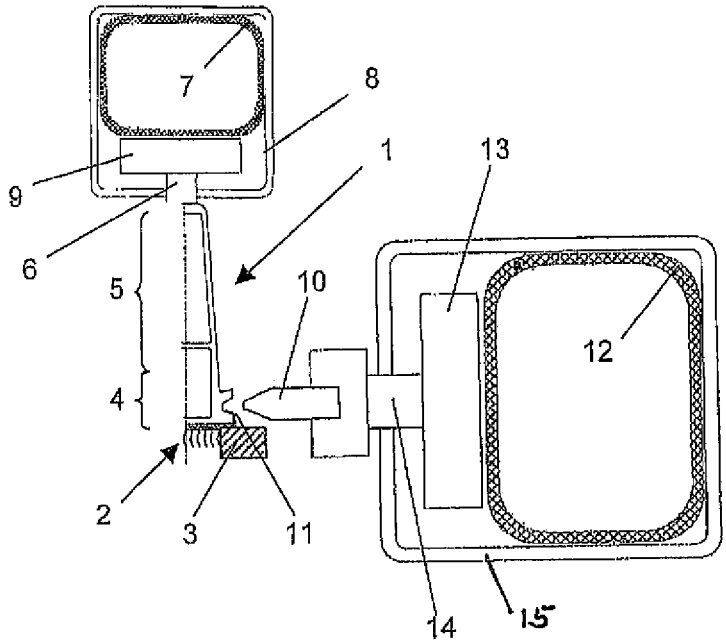
FIG. 1 is a diagrammatic representation of an embodiment of the device in accordance with aspects of the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows the device diagrammatically in an embodiment according to the invention. The card flat bar 1 and the flexible clothing 2, or the clothing strip 2, are placed into the device and positioned on a receiving means 3. The card flat bar 1 is composed of a card flat foot 4 and a web 5 arranged above it. The card flat bar 4 bears with the clothing take-up surface on the clothing strip 2. The clothing strip 2 in turn bears with the clips 11 attached thereto on the receiving means 3. The card flat bar 1 is held over the clothing strip 2 and the clips 11 thereof on the receiving means 3 by the ram 6. The ram 6 is pressed by the compression hose 7 under pressure against the web 5 of the card flat bar 1. The compression hose 7 is thereby held in a housing 8 and presses the ram 6 via the piston 9 onto the card flat bar 1.

FIG. 1 shows the press ram 10 after the integral forming of the clip 11 on the card flat foot 4. The press ram 10 is driven by a compression hose 12 via a piston 13. The compression hose 12 is shown in the relieved form. If the compression hose 12 is acted on with compressed air, due to its expansion, the compression hose 12 pushes the piston 13 in the direction of the card flat bar 1. The connection 14 between the piston 13 and the press ram 10 is guided through the housing 15, in which the compression hose 12 is held. The connection 14 can be embodied at several points by connection holes or on the entire length of the card flat bar 1 by a slot in the housing 15.

Figure 2:
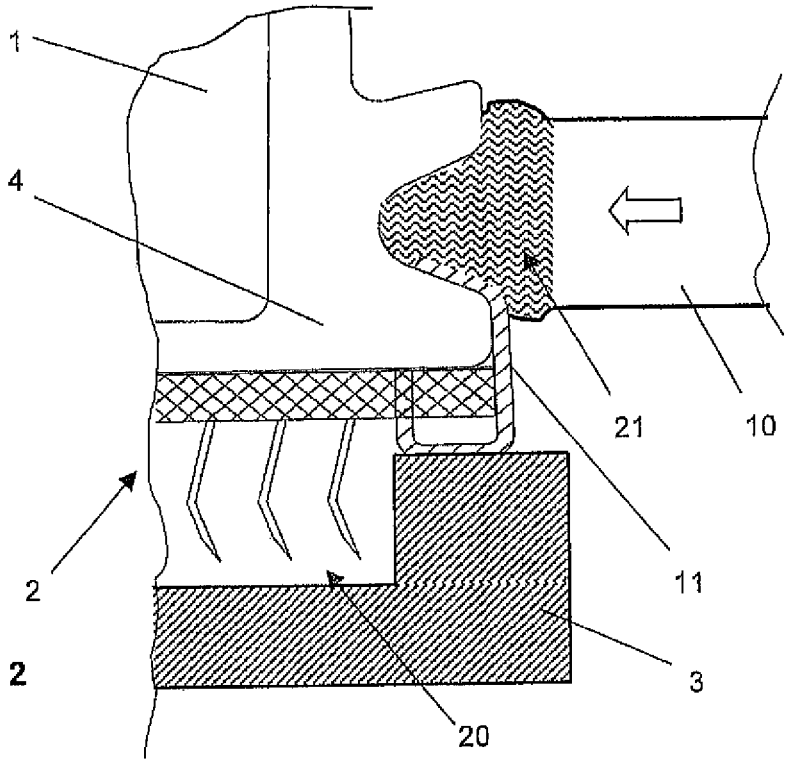
FIG. 2 is a diagrammatic representation of an embodiment for the integral forming of the clips in an enlargement.

FIG. 2 shows in an enlarged manner the integral forming of the clip 11 on the card flat foot 4 by the press ram 10. The card flat bar 1 bears on the clothing strip 2, which in turn bears over the clips attached thereto on the receiving means 3. The receiving means 3 is provided with a depression 20 for the clothing or the needles thereof. The press ram 10 is pressed by the compression hose (see FIG. 1) against the card flat foot 4. The press ram 10 is provided with an elastic tip 21, which adapts to the shape of the card flat foot 4 and renders possible an integral forming of the clip 11 to the contour of the card flat foot 4.

FIG. 3 shows in diagrammatic representation an embodiment of the means for accommodating the card flat bar and the clothing strip in the device. FIG. 3 shows a receiving means 3 over the length of a card flat bar. The two ends 28, 29 of the receiving means 3 are connected by a clamping means 30. The clamping means 30 is arranged at a distance "l" to the bearing surface 33, on which the clips of the clothing strip bear. A contraction of the clamping means 30 in the arrow direction thus causes the receiving means 3 to be bent, and the bearing surface 33 is given a convex form according to the dashed line 31. The camber h in the center of the receiving means 3 is a gauge of the linearity of the receiving means 3. In the case of a straight-line bearing surface 33, the camber h is zero. By means of the clamping means 30, a camber h of 0.2 mm or more can be achieved, depending on the design and elasticity of the receiving means 3.

FIGS. 4*a* and 4*b* show in diagrammatic sectional representation two embodiments of the receiving means 3 at the position X-X in FIG. 3. In FIG. 4*a* the bearing surface 33 is interrupted by the depression 20. The clothing is accommodated in the depression 20, while the clips are supported on the bearing surfaces 33 arranged on both sides of the depression 20. The bearing surfaces 33 can also be embodied as beams which are connected to one another only at the two ends 28, 29, as is shown in FIG. 4*b*. The attachment option for the attachment of the clamping means 30 is not shown. Tie rods or springs can be used as clamping means 30. In the case of an embodiment according to FIG. 4*b*, lower clamping forces are necessary than with an embodiment according to FIG. 4*a* in order to achieve a camber h of the same size.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. A device for attaching a flexible clothing strip to a card flat bar or a revolving card flat, wherein the card flat bar includes a card flat foot with a clothing take-up surface and a web disposed above the card flat foot, and wherein the clothing strip includes clips for attachment to the card flat foot, the device comprising:

a receiver configured to accommodate and hold the card flat bar and clothing strip, the receiver further comprising a bearing surface having an adjustable linearity in a longitudinal direction of the card flat bar;

movable press rams configured on opposite sides of the card flat bar and guided in a movable direction that is generally parallel to the take-up surface and transverse to the longitudinal direction of the card flat bar, the press rams moveable into engagement with the clips thereby causing the clips to deform to the card flat foot;

a drive configured with the press rams, the drive comprising a first compression hose that expands under pressure to cause movement of the press rams; and a clamping mechanism attached to the receiver at locations so as to provide adjustment of the linearity of the bearing surface upon actuation of the clamping mechanism.

2. The device as in claim 1, further comprising a second compression hose disposed so as to press the card flat bar onto the receiver in an expanded state of the second compression hose.

3. The device as in claim 2, wherein at least one of the first or second compression hoses is actuated by compressed air.

4. The device as in claim 1, further comprising a piston operably disposed between the first compression hose and each of the press rams.

5. The device as in claim 1, wherein the first compression hose is divided into multiple operable sections along a length of the device.

6. The device as in claim 1, further comprising a display that depicts linearity of the bearing surface.

7. The device as in claim 1, wherein the linearity of the bearing surface is adjustable from 0.0 mm to any point up to 0.2 mm by variable actuation of the clamping mechanism.

8. The device as in claim 1, further comprising a cover around all sides of the device, the cover comprising cutouts on a front face thereof through which the card flat bar and clothing strip can be pushed into the device.

* * * * *